US007097155B2

(12) United States Patent
Jackson et al.

(10) Patent No.: US 7,097,155 B2
(45) Date of Patent: Aug. 29, 2006

(54) WINCH OR HOIST INCLUDING A DEVICE FOR SIGNALING WHEN A PRESET MINIMUM NUMBER OF CABLE WINDINGS ARE LEFT ON A WINDING DRUM

(75) Inventors: David C Jackson, Jenks, OK (US); Ike Baldwin, Jenks, OK (US); Garry Knight, Santa Ana, CA (US); Simon Worboys, Santa Ana, CA (US)

(73) Assignee: Tulsa Winch, Inc., Jenks, OK (US)

( * ) Notice: Subject to any disclaimer, the term of this patent is extended or adjusted under 35 U.S.C. 154(b) by 29 days.

(21) Appl. No.: 10/892,680

(22) Filed: Jul. 16, 2004

(65) Prior Publication Data

US 2006/0163547 A1 Jul. 27, 2006

(51) Int. Cl.
*B66D 1/48* (2006.01)

(52) U.S. Cl. ..... 254/276; 242/534; 242/563

(58) Field of Classification Search ..... 254/276, 254/266, 267; 242/223, 413, 413.1, 534, 242/534.2, 563, 912
See application file for complete search history.

(56) References Cited

U.S. PATENT DOCUMENTS

| | | | | |
|---|---|---|---|---|
| 2,683,020 | A | 7/1954 | Nickle | |
| 3,750,130 | A | 7/1973 | Lute | |
| 3,883,859 | A | 5/1975 | Ancheta | |
| 4,119,299 | A | 10/1978 | Dietrich et al. | |
| 4,334,217 | A | 6/1982 | Nield et al. | |
| 4,387,295 | A | 6/1983 | Minichiello | |
| 4,475,163 | A | 10/1984 | Chandler et al. | |
| 5,632,469 | A * | 5/1997 | Heun et al. | 254/267 |
| 5,906,358 | A | 5/1999 | Baziuk et al. | |
| 5,988,596 | A | 11/1999 | Mitchell et al. | |
| 2005/0072965 | A1 * | 4/2005 | Sanders et al. | 254/361 |

FOREIGN PATENT DOCUMENTS

| | | |
|---|---|---|
| DE | 1990091 | 7/2000 |
| DE | 0029757 | 10/2001 |
| GB | 2074970 | 11/1981 |

* cited by examiner

*Primary Examiner*—Emmanuel M Marcelo
(74) *Attorney, Agent, or Firm*—Ladas and Parry LLP

(57) ABSTRACT

A method and apparatus for indicating when only a given minimum preset number of winding layers are present on a drum of a winch. An optical sensor system is included in a space in a hollow housing to count the number of revolutions of the drum and the direction of rotation to produce an alarm signal when only the minimum number of winding layers remains on the drum.

33 Claims, 3 Drawing Sheets

WINCH OR HOIST INCLUDING A DEVICE FOR SIGNALING WHEN A PRESET MINIMUM NUMBER OF CABLE WINDINGS ARE LEFT ON A WINDING DRUM

FIELD OF THE INVENTION

The invention relates to a winch or hoist and in particular to incorporation in the winch or hoist of a device for detecting and signaling when a preset minimum number of cable windings remain on a winding drum.

The invention further relates to a method for signaling to an operator when a pre-set minimum number of cable windings remain on the drum.

BACKGROUND

The operator of a winch or hoist, either on a crane or on a truck, cannot always see the load that is being moved which can present a hazard when being lowered. When making a lift or pull, operators are frequently guided by an additional person giving directions either by radio or by hand signals. A need exists to prevent the operator of a winch or hoist from spooling off all of the cable on a winch drum and particularly a requirement exists for an indicator of how many wraps of cable remain on the winch drum. In the industry it is typically called a "third wrap indicator" and as the name implies this device warns the operator with an audible or visual signal when only three wraps of cable remain on the winch drum.

Several methods are known to determine the amount of cable that is left on a cable drum of a winch. These frequently use separate idler sheaves that the cable engages which can lead to error due to cable slippage. In another method an algorithm is used to calculate the amount of cable on the drum. The algorithm method considers the revolutions of the drum and the amount of cable that is analytically on the drum at any instant. However, it relies on the assumption that the cable wraps perfectly for each revolution of the drum. Current systems all use an indirect means to calculate the amount of cable that is on the drum or has passed over the drum. As the cable is wound on the drum, each layer has a different amount because the circumference has changed. The current systems rely on the proposition that each wrap of cable is wound analytically perfect. This is very difficult to achieve in practice and therefore it is difficult to accurately measure the length of a cable as it wraps on the drum.

U.S. Pat. No. 3,883,859 shows a load height indication with a rotation-measuring device and indicator to display the load position in numbers of feet from a reference point.

U.S. Pat. No. 4,387,295 shows a pneumatic penetration sensor for oil drilling with paying out of a first layer of cable from the drum, the sensor pulses being coupled to a first pneumatic counter, which is preset so as to provide an output pulse corresponding to a predetermined increment of motion during the paying out of the first layer. Additional counters are provided with different preset limits so that they will provide output pulses corresponding to the predetermined increment of motion during the paying out of second and additional layers of cable from the drum.

U.S. Pat. No. 4,475,163 shows a system for calculating and displaying cable payout from a rotatable drum storage device with up/down counter 43 to count the net value as accumulated from a predetermined reference zero position, e.g. "0" cable paidout. A calculating capability in arithmetic unit 44 performs the required computations and a clock source 45 provides a timing reference for a computer.

The following references are of general interest for showing cable payout from a drum.

U.S. Pat. No. 2,683,020; U.S. Pat. No. 3,750,130; U.S. Pat. No. 4,119,299; U.S. Pat. No. 4,334,217; U.S. Pat. No. 5,906,358; U.S. Pat. No. 5,988,596; DE010029757; DE019900916; GB002074970.

SUMMARY OF THE INVENTION

An object of the invention is to provide apparatus for counting drum revolutions of a winch or hoist which avoids the deficiencies of the known art.

A further object of the invention is to depart from the current art which measures the exact length of cable and instead to measure the number of revolutions of the drum. This is more accurate because if the cable does not wrap on the drum perfectly, the drum still will revolve a finite number of revolutions or partial revolutions to that point. Therefore, the invention seeks to count the number of revolutions of the drum, not the length of the cable as in the known art.

In accordance with the invention, it is assumed that the revolutions of a cable drum of a winch or hoist are proportional to the amount of cable on the drum. This proportionality is used to provide a warning signal at a specific particular drum revolution count. Hence, an operator will be warned when a predetermined amount of cable is left on the cable drum of the winch. The internal winch gearing is used to drive a disc having alternating light and dark segments or segments of different color or the like that is then read by two optical infrared sensors spaced a radial distance apart. A predetermined amount of cable is spooled onto the drum and the system is then initialized. Several initialization points for the amount of cable spooled on the drum can be provided for different levels of warning depending upon the speed of the winch. This system has the ability to warn audibly or visually or by a combination of both when the initialization points are reached after spooling off of the cable.

To initialize the system, the desired amount of cable is spooled on the drum and a software program is initialized as a warning reference point. The remaining amount of cable is then spooled onto the drum as the software counts the number of drum revolutions. When the cable is thereafter spooled on or off the drum, the number of drum revolutions is counted and a warning signal will be given if the initialization point is reached.

In accordance with the invention, the winch comprises a winding drum on which a cable can be wound and unwound, drive means for driving the drum in rotation in opposite directions to wind and unwind the cable on the drum, and indicator means for producing output signals based on drum revolutions for signaling when a preset number of windings are present on the drum. The indicator means comprises a stationary hollow housing, a drive shaft rotatably supported by the hollow housing for being driven by the drive means in proportion to rotation of the drum and a sensor means in the hollow housing and driven by the drive means for producing signals related to the revolutions of the drum and the direction of rotation thereof. The output signals are based on the signals received from the sensor means and indicate when the preset number of winding layers of the cable are present on the drum.

The sensor means comprises an optical disc driven in rotation by the drive shaft and having alternating segments of distinguishing appearance arranged around the axis of rotation of the optical disc, and a fixed disc in the hollow housing coaxially facing the optical disc and having sensor elements thereon to produce the signals related to the revolutions of the drum and the direction of rotation thereof as the segments of the optical disc pass the sensor elements. A conditioner circuit receives the signals from the sensor elements and produces the output signals indicating that the preset number of windings are present on the winding drum.

According to a further aspect of the invention, the indication of when a preset number of layers of cable winding are present on the winding drum of the winch is produced by a self-contained unit having a drive shaft driven in rotation in relation to rotation of the winding drum, an optical sensor means associated with the drive shaft for producing signals indicative of the rotation of the winding drum, and conditioner means for receiving the signals from the optical means for producing output signals when the preset number of layers of cable windings are present on the winding drum.

The self-contained unit is inserted and secured in a housing of the winch such that the drive shaft is connected to a drive motor of the winding drum and is rotated in relation to the rotation of the winding drum.

The optical sensor includes an optical disc driven in rotation by the drive shaft, a fixed disc coaxially facing the optical disc and provided with sensor elements to detect rotation of the optical disc. The conditioner means is connected to receive signals from the sensor elements for producing the output signals when the preset number of layers of cable windings are present on the winding drum.

The optical sensor disc has alternating segments of distinguishing appearance and the sensor elements senses travel of the alternating segments therepast.

The conditioner means includes a circuit which is programmed to receive an input value when the preset number of layers of cable windings are on the drum and to count drum revolutions so that when the cable is unwound from the winding drum, the output signal will be produced when said preset number is reached.

The invention also provides a method for signaling when a predetermined minimum number of windings remain on the drum.

The invention also contemplates a method which comprises the steps of:

driving the optical disc from the drive shaft of the winch, forming the optical disc with the alternating distinguishing segments, such as light and dark segments, sensing passage of the alternating segments past the optical sensor, determining from the passage of the alternating segments the direction of rotation of the drum and the number of layers of windings on the drum, and producing an output signal, when the cable is unwound from the drum and a predetermined number of windings layers remain on the drum, to warn an operator thereof

DETAILED DESCRIPTION OF A PREFERRED EMBODIMENT

Figure 1:
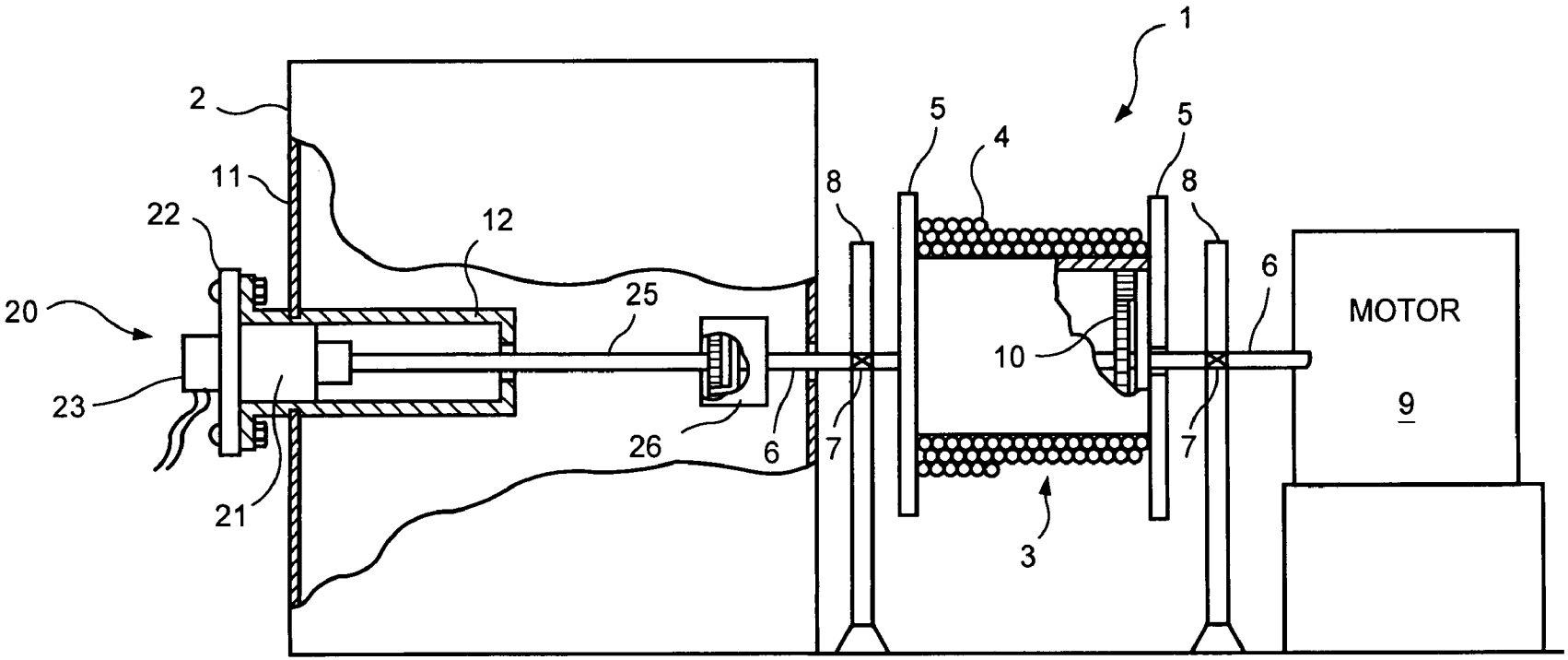
FIG. 1 is a diagrammatic illustration, partially broken away and in section, of a winch incorporating a self-contained device, according to the invention, for counting drum revolutions of a cable winding drum of the winch and for indicating when only a minimum pre-set number of winding layers remains on the drum.
Figure 2:
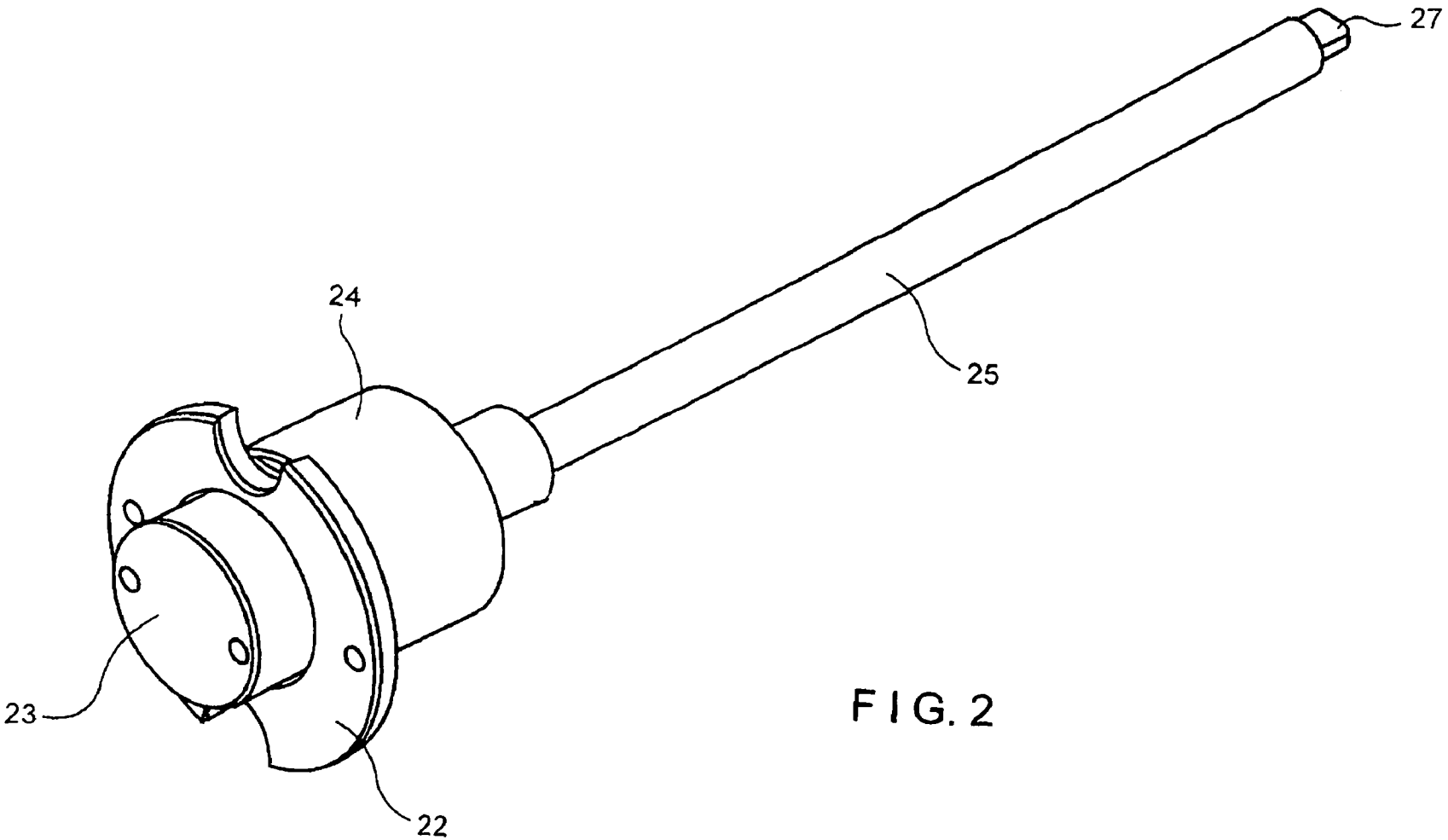
FIG. 2 is a perspective view of the self-contained device in FIG. 1.
Figure 5:
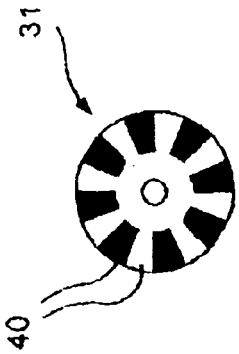
FIG. 5 is a front view of an optical disc of the assembly as seen along line 5—5 in FIG. 3.
Figure 4:
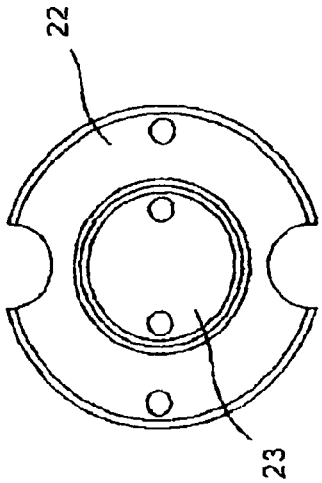
FIG. 4 is an end view of the self-contained device in FIG. 2.

The drawing illustrates a hoist or winch 1 adapted for being mounted on a crane or truck (not shown). The winch 1 is operated by an operator at a remote location where the operator generally cannot see a load on the winch especially when the load is almost fully payed out. For this reason, it is important to warn the operator when a minimum number of windings remain on the drum of the winch. The invention provides such a system and it will be described hereafter with reference to the drawings.

The winch 1 comprises a housing 2 and a cable winding drum 3 on which a cable 4 is wound or unwound depending on whether the load (not shown) attached to the cable is being raised or lowered. The drum 3 has integral radial flanges 5 at the ends thereof. A rotatable shaft 6 extends through the cable drum 3. The shaft 6 is rotatably supported in bearings 7 supported in pedestals 8. A motor 9 drives the shaft 6 in rotation. The shaft 6 drives a sun planetary gear transmission 10 thereby driving the drum 3 in rotation. The motor is controlled by the operator in a manner well known to those skilled in the art.

The housing 2 has a side wall 11 to which is secured an open tubular support sleeve 12.

A self-contained indicating and signaling device 20 is secured in a tubular support sleeve 12 for counting drum revolutions and indicating when only a given pre-set minimum number of winding layers of cable 4 are present on the drum 3 and for signaling that the pre-set number of winding layers has been reached.

The device 20 includes a hollow housing 21 which is fitted in support sleeve 12. The housing 21 has an integral end flange 22 which is secured to an end flange of sleeve 12 to fix the housing 21 within sleeve 12. An end plug 23 is secured in one end of housing 21. A tubular stem 24 is formed at the opposite end of housing 21. A drive shaft 25 is rotatably supported in stem 24 in an axially secured position and drive shaft 25 extends into the interior space in hollow housing 21. The drive shaft 25 is driven from shaft 6 of motor 9 via a gear transmission 26. Although the gear transmission 26 and gear transmission 10 have been shown separately, they can be integrated into a common gear transmission. The drive shaft 25 has a tang 27 at its free end which engages in a drive slot in the gear transmission 26 so that the drive shaft 25 is driven by the gear transmission.

Figure 3:
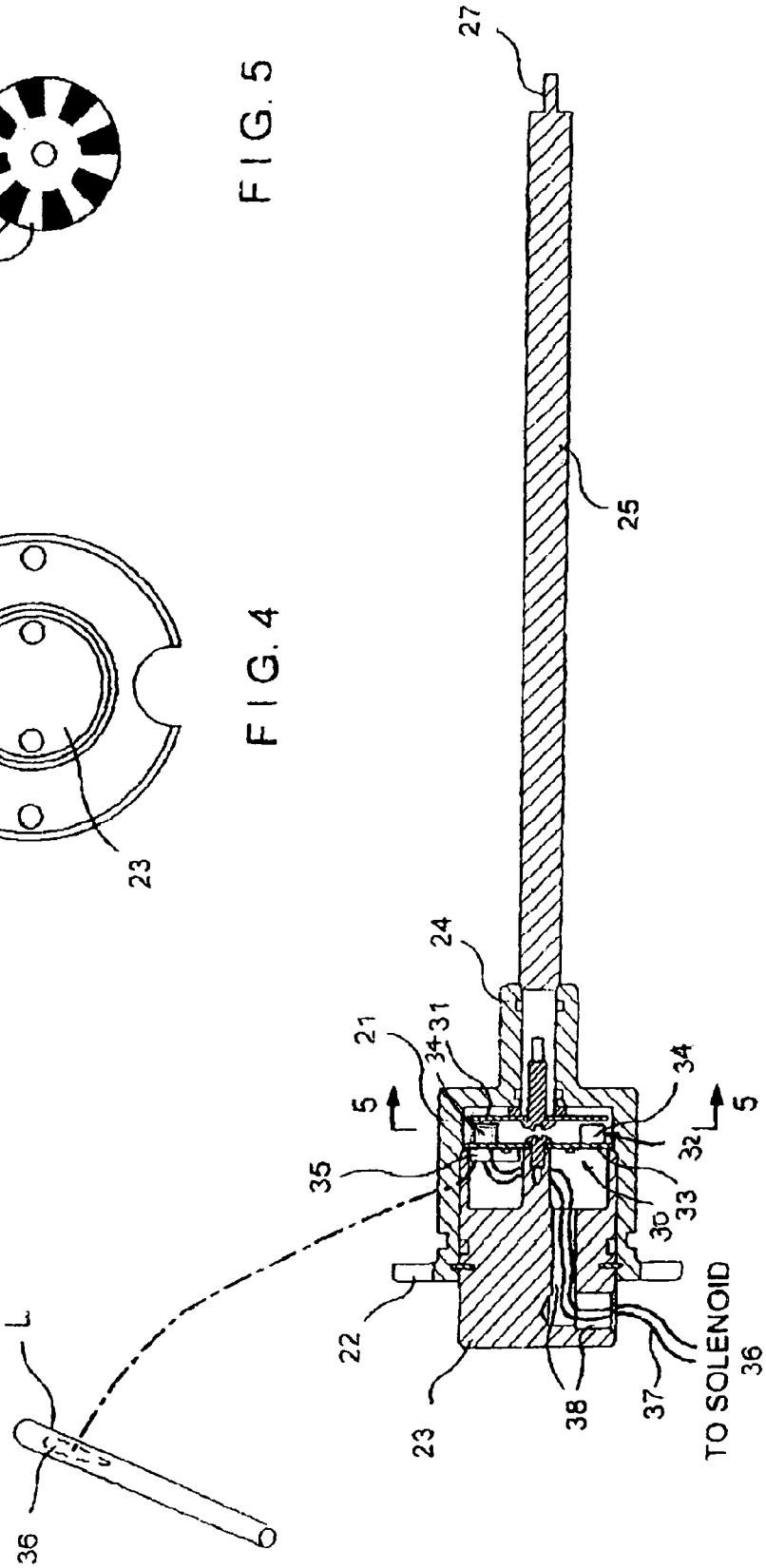
FIG. 3 is a longitudinal sectional view of the self-contained device in FIG. 2.

The device 20 incorporates a system 30 (FIG. 3) which detects rotation of drive shaft 25 and thereby of drum 3.

The system 30 includes an optical disc 31 secured to drive shaft 25 and driven thereby from transmission 26 at a rotational speed related to the rotational speed of drum 3 on which the cable is wound.

The optical disc 31 is divided into a number of equal segments 40 distributed uniformly around the axis of rotation of disc 31. The segments 40 are formed with alternating distinctive features such as alternating dark and light segments, alternating colors or other distinctive appearance capable of being read by a sensor means 32 facing the optical disc 31. The sensor means 32 is attached to a disc 33 which is fixed to housing 21 by engagement with end plug 23 such that the sensor means 32 is disposed within the interior of hollow housing 21.

The disc 33 is fixed in housing 21 coaxially with optical disc 31 and the sensor means comprises two sensor elements 34, such as IR sensors, arranged in diametrically opposite positions on the disc 33. The sensor elements 34 face the segments 40 on optical disc 31 and produce pulsed output signals as the alternate segments 40 on the optical disc 31 pass the sensor elements 34. The pulsed output signals of the optical sensor elements 34 are fed to a conditioner circuit 35 fixed to the back surface of disc 33. The conditioner circuit 35 contains a software program which can convert the pulsed signals from the sensor elements 34 into signals representing the number of revolutions of the drum 3 and the direction of rotation thereof.

A non-volatile memory of the software program is initialized when a given pre-set number of windings are on the drum, for example, three windings. Therefore, when a load is being raised, the number of winding layers on the drum will increase whereas when the load is being lowered the number of winding layers will decrease. When the load is lowered from a raised position and the number of winding layers reaches the pre-set initialized value, the conditioner circuit 35 is programmed to produce an output signal which is sent to an alarm system 36 to warn the operator that the minimum number of winding layers is present on the drum. Instead of a single initialization point, several initializing points can be set in the program. The alarm system 36 can produce an audible output, a visual output or a combination of both.

The output signal from the conditioner circuit 35 is transmitted to the alarm system 36 by connecting cables 37 extending in passages 38 provided in plug 23. Alternatively, the output signals from the conditioner circuit can be transmitted wirelessly to the alarm system, for example, as an RF signal or the like. The conditioner circuit 35 includes its own power supply, for example, a battery.

In effect, the sensor means serves as a counter to count the number of cable windings on the drum, as the cable is being wound thereon, based on the generation of pulsed signals by the sensor elements 34, and thereafter to count down as the cable is being unwound from the drum until the initialization point or points are reached to produce the output alarm signal.

The system of the invention is simple to install and since it is contained in the hollow space in the housing 21 it is not subject to external influences and is maintenance-free.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. A winch comprising a winding drum on which a cable can be wound and unwound, drive means for driving the winding drum in rotation in opposite directions to wind and unwind the cable on the drum, and indicator means for producing output signals based on drum revolutions for signaling when a preset number of winding layers are present on the drum, said indicator means comprising a stationary hollow housing, a drive shaft driven by said drive means in proportion to rotation of said drum, said drive shaft being rotatably supported by said hollow housing, an optical system including optical elements disposed in said hollow housing in driving connection with said drive shaft for producing signals related to the revolutions of said drum and to the direction of rotation thereof and means for producing said output signals, based on signals received from said optical system which indicate when the preset number of winding layers of said cable are present on said drum.

2. The winch of claim 1, comprising an alarm means for producing an alarm signal in response to said output signals.

3. The winch of claim 2, wherein said alarm signal is an audible signal, a visual signal or a combination of both.

4. The winch of claim 1, wherein said optical elements comprise an optical disc in said hollow housing driven in rotation by said drive shaft, said optical disc having alternating segments of distinguishing appearance, and a fixed disc in said hollow housing coaxially facing said optical disc and including sensor elements thereon to produce signals related to the revolutions of said drum and the direction of rotation thereof as said segments of said optical disc pass said sensor elements, said means for producing said output signals comprising a conditioner circuit connected to receive the signals from said sensor elements.

5. The winch of claim 4, wherein said conditioner circuit includes a program for determining the number of winding layers on said drum based on the signals produced by said sensor elements, and a programmable memory in which one or more values of the preset minimum number of winding layers are introduced.

6. The winch of claim 4, wherein said optical elements are located diametrically opposite one another.

7. The winch of claim 4, wherein said alternating segments are alternately dark and light.

8. The winch of claim 4, wherein said alternating segments are of different color.

9. The winch of claim 4, wherein said output signals from the conditioner circuit are transmitted to an alarm means for producing an alarm signal.

10. The winch of claim 9, wherein said output signals from the conditioner circuit are transmitted wirelessly to said alarm means.

11. The winch of claim 4, wherein said hollow housing is secured in a fixed sleeve in said housing.

12. The winch of claim 11, wherein said housing includes an end wall in which said sleeve is secured, said hollow housing being inserted in said sleeve and secured therewith.

13. The winch of claim 12, wherein said drive means includes a drive motor, said drive shaft being driven by said drive motor.

14. A system for indicating when a preset number of layers of cable winding are present on a winding drum of a winch, said system comprising a self-contained unit comprising a drive shaft having means for being rotated in relation to rotation of the winding drum, an optical system contained in a hollow housing and operatively coupled to said drive shaft for producing signals indicative of the rotation of the winding drum, and conditioner means for receiving the signals from said optical system for producing an output signal when the preset number of layers of cable winding are present on the winding drum.

15. The system of claim 14, wherein said self-contained unit is inserted and secured in said hollow housing, said drive shaft being connected to a drive motor of the winding drum and rotated in relation to the rotation of the winding drum.

16. The system of claim 14, wherein said optical system comprises an optical disc driven in rotation by said drive shaft, a fixed disc coaxially facing said optical disc and including sensor elements to detect rotation of the optical disc, said conditioner means being connected to receive signals from said sensor elements for producing said output signal when the preset number of layers of cable winding are present on the winding drum.

17. The system of claim 16, wherein said optical disc has alternating segments of distinguishing appearance, said sensor elements sensing travel of said alternating segments therepast to produce pulses of signals.

18. The system of claim 17, wherein said sensor elements are diametrically opposed to one another.

19. The system of claim 17, wherein said conditioner means comprises a circuit which is programmed to receive an input value indicating when the preset number of layers of cable winding is on the drum and to count drum revolutions based on the pulses from the sensor elements so that when the cable is unwound from the winding drum, said output signal will be produced when said preset number is reached.

20. The system of claim 17, wherein said alternating segments are alternately dark and light.

21. The system of claim 17, wherein said alternating segments are of different color.

22. The system of claim 14, wherein said output signal from the conditioner means is transmitted to an alarm means for producing an alarm signal.

23. The system of claim 14, wherein said output signal from the conditioner means is transmitted wirelessly to said alarm means.

24. The system of claim 14, wherein said hollow housing has an interior space in which said optical system and said conditioner means are contained, said drive shaft being rotatably supported in said hollow housing and coupled to said optical system.

25. Apparatus for indicating when only a given minimum number of winding layers of cable are present on a drum of a winch, said apparatus comprising optical means responsive to rotation of the drum to produce pulsed output signals indicative of the number of drum revolutions and direction of drum rotation, a stationary hollow housing, said optical means being disposed in said stationary hollow housing and including a conditioner circuit to receive said pulsed output signals and produce an alarm signal when a number of windings of the cable on the drum reaches a predetermined minimum value, wherein said optical means comprises a rotatable optical disc which is rotated when said drum rotates and an optical sensor means facing said optical disc for producing said pulsed output signals as the optical disc rotates.

26. The apparatus of claim 25, wherein said optical sensor means is stationary and secured to said conditioner circuit as an integral unit.

27. The apparatus of claim 25, wherein said optical sensor means and said optical means coaxially face one another in said hollow housing.

28. An optical system for producing a warning signal when a preset number of winding layers of cable are present on a cable drum of a winch, said optical system comprising an optical disc rotatable in relation to rotation of the cable drum, a fixed sensor element facing said optical disc, said optical disc having alternating segments of different characteristics such that as the optical disc rotates, the alternating segments pass the sensor element which produces pulsed output signals, and a conditioner circuit receiving said pulsed output signals, said conditioner circuit being programmed with an initialization value corresponding to a pre-set number of winding layers on the cable drum, and determining the number of revolutions of the drum when the cable is unwound from the drum based on said pulsed signals to produce said warning signal when the cable has been unwound from the drum and said pre-set number of winding layers is reached.

29. The optical system of claim 28, wherein a plurality of said preset number of winding layers are programmed in said conditioner circuit and warning signals are produced when the number of winding layers on the drum reach said preset numbers.

30. The optical system of claim 28, wherein said sensor elements and said conditioner circuit are mounted on a fixed disc coaxially facing said optical disc.

31. A method for signaling when a predetermined minimum number of windings are present on a drum of a winch, said method comprising the steps of:

driving an optical disc from a drive shaft of the winch, forming said optical disc with alternating light and dark segments, sensing passage of the alternating light and dark segments when the optical disc is rotated, determining from the passage of the alternating light and dark segments the direction of rotation of the drum and the number of layers of windings on the drum, and producing an output signal when the cable is unwound from the drum and a predetermined minimum number of windings layers remain on the drum to warn an operator thereof.

32. The method of claim 31, wherein the output signal is audible, visual or both.

33. The method of claim 31, further comprising:

forming an initialization value when the predetermined number of windings are present on the drum, the number of windings on the drum increasing as the cable is wound on the drum, said output signal being produced when the cable is unwound from the drum and the number of windings reaches the predetermined minimum.

* * * * *